US009903572B2

(12) United States Patent
Torres

(10) Patent No.: US 9,903,572 B2
(45) **Date of Patent: *Feb. 27, 2018**

(54) SUSPENDABLE LIGHT FIXTURE

(71) Applicant: Milyon, LLC, Pipersville, PA (US)

(72) Inventor: Roman Torres, Philadelphia, PA (US)

(73) Assignee: Milyon, LLC, Pipersville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/452,238

(22) Filed: Mar. 7, 2017

(65) Prior Publication Data

US 2017/0175985 A1 Jun. 22, 2017

Related U.S. Application Data

(63) Continuation of application No. 14/878,383, filed on Oct. 8, 2015, now Pat. No. 9,625,110.

(60) Provisional application No. 62/061,504, filed on Oct. 8, 2014.

(51) Int. Cl.

| | |
|---|---|
| ***F21V 21/008*** | (2006.01) |
| ***F21V 21/14*** | (2006.01) |
| ***F21S 8/06*** | (2006.01) |
| ***F21S 9/02*** | (2006.01) |
| ***F21V 15/01*** | (2006.01) |
| *F21W 121/00* | (2006.01) |
| *F21V 13/02* | (2006.01) |

(52) U.S. Cl.

CPC ..... *F21V 21/14* (2013.01); *F21S 8/06* (2013.01); *F21S 9/02* (2013.01); *F21V 15/01* (2013.01); *F21V 21/008* (2013.01); *F21V 13/02* (2013.01); *F21W 2121/00* (2013.01)

(58) Field of Classification Search

CPC ..... F21K 9/00; F21K 9/02; F21S 8/06; F21S 8/061; F21S 8/063; F21S 8/068; F21S 9/02; F21V 23/007; F21W 2121/00; F21Y 2103/10; F21Y 2115/10; G02F 1/133606

USPC ..... 362/190, 191, 198, 249.01, 249.02, 299, 362/300, 302, 308–310, 328, 329, 347, 362/350, 404–407

See application file for complete search history.

(56) References Cited

U.S. PATENT DOCUMENTS

| | | | | |
|---|---|---|---|---|
| 3,725,697 | A * | 4/1973 | Wince | F21V 5/02 362/294 |
| 7,025,480 | B2 | 4/2006 | De'Armond | |
| 9,625,110 | B2 * | 4/2017 | Torres | F21S 8/06 |

* cited by examiner

*Primary Examiner* — Hargobind S Sawhney
(74) *Attorney, Agent, or Firm* — Christopher & Weisberg, P.A.

(57) ABSTRACT

A suspendable includes a housing including a light reflective material. The housing defines an aperture proximate the center of the housing configured to receive a light source. The housing further defines at least two pairs of through holes; a first channel extending between the a first pair of the at least two pairs of through holes and a second channel extending between the second pair of the at least two pairs of through holes, the first channel and the second channel collectively defining a pathway entirely through the housing; the first and second channels each being curvilinear; an at least two substantially arcuate grooves.

15 Claims, 6 Drawing Sheets

SUSPENDABLE LIGHT FIXTURE

CROSS-REFERENCE TO RELATED APPLICATION

This application is a continuation to U.S. patent application Ser. No. 14/878,383 filed Oct. 8, 2015, entitled SUSPENDABLE LIGHT FIXTURE and claims priority to U.S. Provisional Patent Application Ser. No. 62/061,504, filed Oct. 8, 2014, entitled SUSPENDED LIGHT FIXTURE WITH A CONCEALABLE LIGHT SOURCE the entirety of which is incorporated herein by reference.

STATEMENT REGARDING FEDERALLY SPONSORED RESEARCH OR DEVELOPMENT n/a

FIELD OF THE INVENTION

The present invention relates to a suspendable light fixture.

BACKGROUND OF THE INVENTION

Current suspended light sources, such as holiday and pendant lights, do not provide for independent movement of each light source and do not conceal part of the light source. Thus, current suspended light sources do not provide for independent positioning of each light with respect to each other light along the wire that the lights are attached and also do not provide ways of reflecting and or diffusing the lights to provide for different lighting effects.

SUMMARY OF THE INVENTION

The present invention advantageously provides a suspendable light fixture. The light fixture includes a housing including a light reflective material. The housing defines an aperture proximate the center of the housing configured to receive a light source. The housing further defines at least two pairs of through holes; a first channel extending between the a first pair of the at least two pairs of through holes and a second channel extending between the second pair of the at least two pairs of through holes, the first channel and the second channel collectively defining a pathway entirely through the housing; the first and second channels each being curvilinear; an at least two substantially arcuate grooves.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
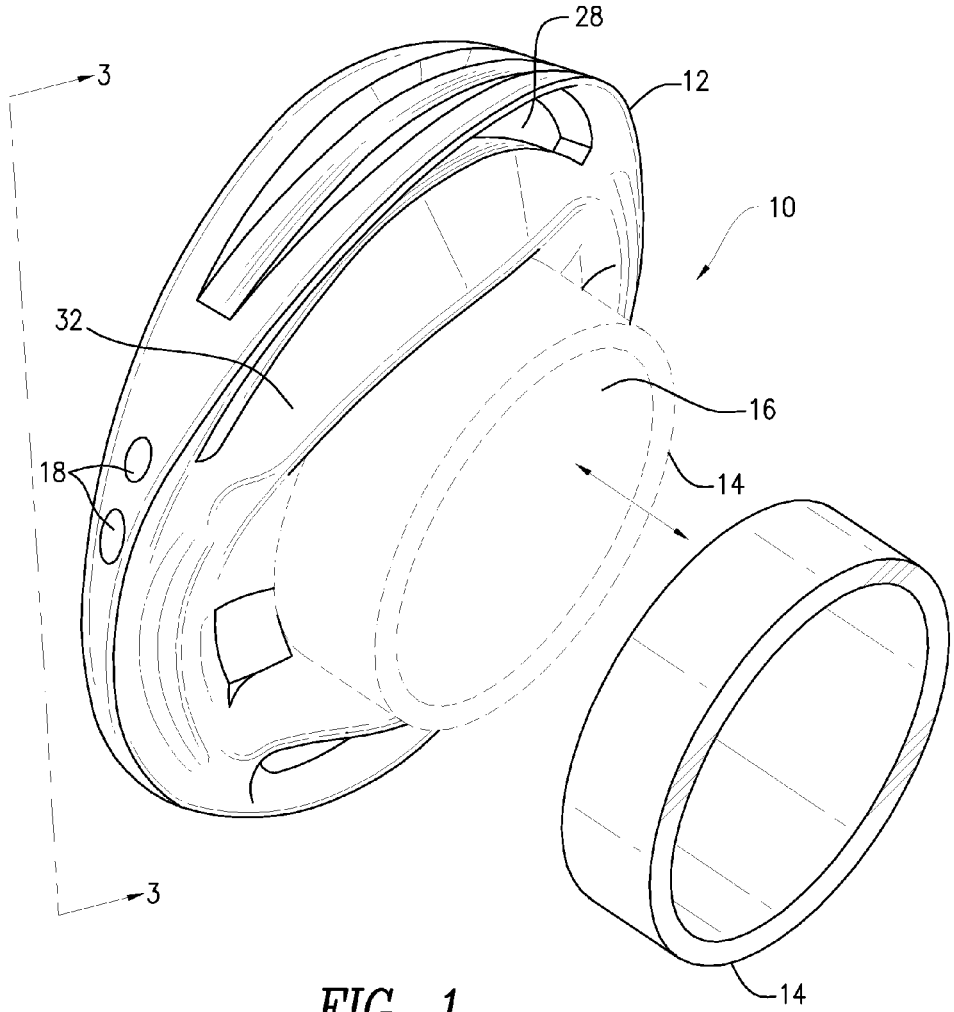
FIG. 1 is a front perspective view of a suspendable light fixture including a light source constructed in accordance with the principles of the present application.

As used here, relational terms, such as "first" and "second," "top" and "bottom," "front and rear," and the like, may be used solely to distinguish one entity or element from another entity or element without necessarily requiring or implying any physical or logical relationship or order between such entities or elements.

Referring now to the drawings in which like reference designators refer to like elements, there is shown in FIGS. 1-7 an exemplary suspendable light fixture constructed in accordance with the principles of the present application and designated generally "10." The fixture 10 may include a housing 12 configured to reflect and diffuse light emitted from a light source 14 configured to be at least one of retained or suspended within the housing 12. In an exemplary configuration the housing 12 is substantially toroidal in shape and defines an aperture 16 configured to receive the light source 14. Other shapes are contemplated for the shape of the housing 12 to provide for a particular light reflection or refraction pattern. In one configuration, the housing 12 may define a thickness in the range of 0.25 in to 2 in and a diameter in the range of 2 in to 12 in. The housing 12 may be composed of plastic, chrome, brass, bronze, resin, or other materials, such as ceramics, glass, wax (for casting), wood, any material that is formable into a prescribed shape or metals.

The light source 14 may be sized to be friction fit within the aperture 16. Alternately, the light source 14 may be sized to be threaded within the aperture 16. For example, the housing 12 may be composed of a flexible material, for example, polyurethane, such that the light source 14 may be push on the portion of the housing 12 defining the aperture 16 to removeably secure the light source within the housing 12. In other configuration, the housing 12 is a plastic such as polycarbonate and the light source 14 is made from a resilient material, such that the light source 14 may flex as it is inserted within the aperture 16. In the configuration shown in FIG. 1, the light source 14 is a substantially cylindrical structure, although any shape is contemplated for the light source 14. The light source 14 may include an array of LED diodes, incandescent filaments, halogens, or fluorescent light sources disposed within the cylindrical structure, either within the wall that defines the light source or within the interior of the substantially cylindrical structure. The light source 14 is further configured to either extend a distance away from the housing 12 from either or both the top and bottom of the housing 12 or may be substantially planar with the housing 12.

The housing 12 may include a plurality of through holes 18 that define respective channels 20 through the housing 12. The through holes 18 and their respective channels 20 define a pathway for insertion of one of more suspension elements 22, for example, a wire or fiber optic cable, to which the housing 12 is slideably affixed. In one configuration, six through holes 18 are provided on each side of the housing 12, which define three curvilinear channels 20 there through. The configuration of the through holes 18 and the channels 20 may be symmetric such that the suspension elements 22 may be readily fed through the channels 20. In an exemplary configuration, at least one of the one or more suspension elements 22 may pass through a respective channel 20, into the aperture 16, through the light source 14 and out through the respective channel 20 on the opposite side of the housing 12. Such a configuration may allow for affixation of the light source 14 within the aperture 16. At least one of the one or more suspension elements 22 may further be configured to provide power to the light source 14. For example, at least one of the suspension elements 22 may be fiber optic cable configured to connect to a power source. One or more of the suspension elements 22 may be configured to electrically couple to the light source 14 when advanced through the light source 14. Alternatively, the housing 12 may include a battery disposed within configured to provide power to the light source 14. It may include a solar powered rechargeable battery to power the light source. It may include a wireless charger to power a low voltage light source.

The housing 12 may include one or more reflectors 24 and/or diffuser 26 defined by the housing 12 and/or disposed on the housing 12. For example, the housing 12 may be coated or otherwise composed with a light reflective material, either entirely reflective such a mirrored surface or partially reflective, such that the shape of the housing 12 provides for particular light distribution patterns. In particular, in one configuration, the housing 12 may define an oblong shape such that the cross-sectional thickness of the housing 12 proximate its center is larger than the cross-sectional thickness towards the perimeter of the housing 12. The oblong shape may provide for particular light distribution as light is emitted from the light source 14. In other configurations, the thickness of the housing 12 may be less toward the center and larger toward the perimeter.

Figure 2:
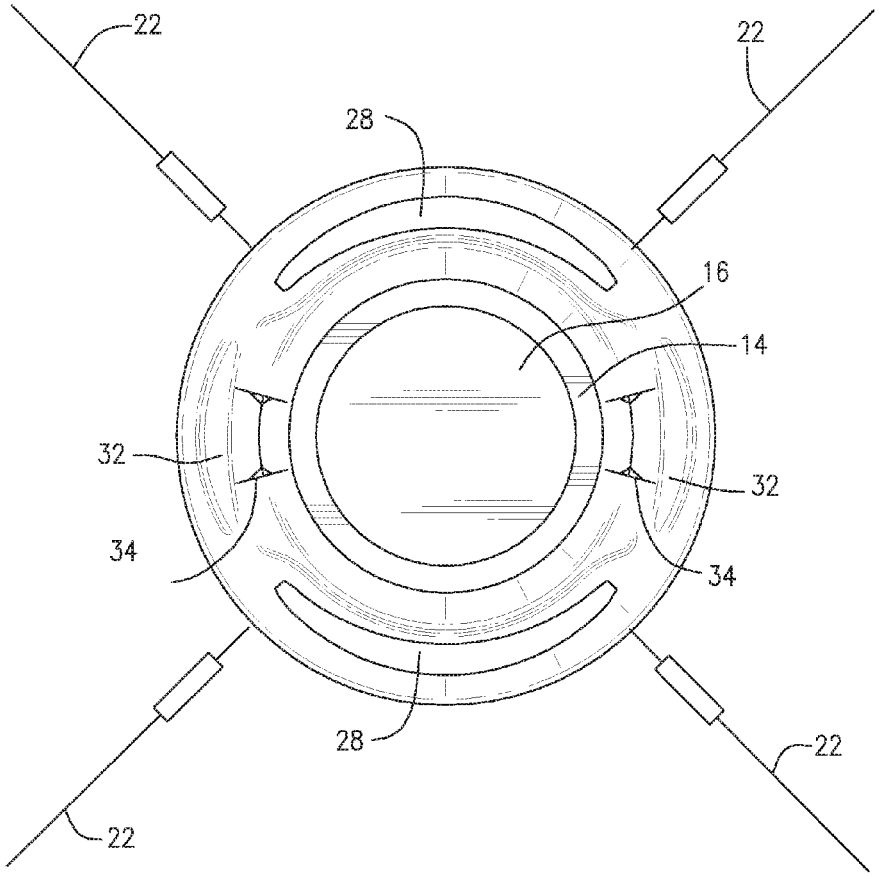
FIG. 2 is a top view of the suspendable light fixture shown in FIG. 1 with wires extending through the fixture.
Figure 3:
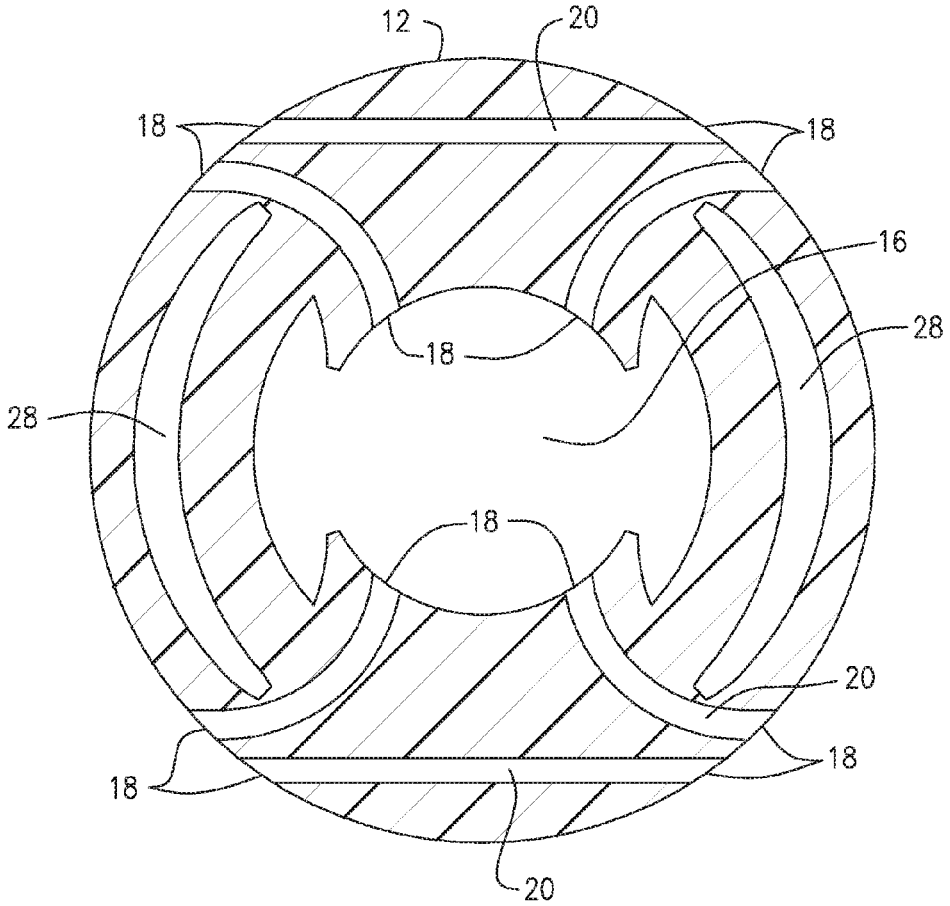
FIG. 3 is a top cross-sectional view of the suspendable light fixture shown in FIG. 1.
Figure 4:
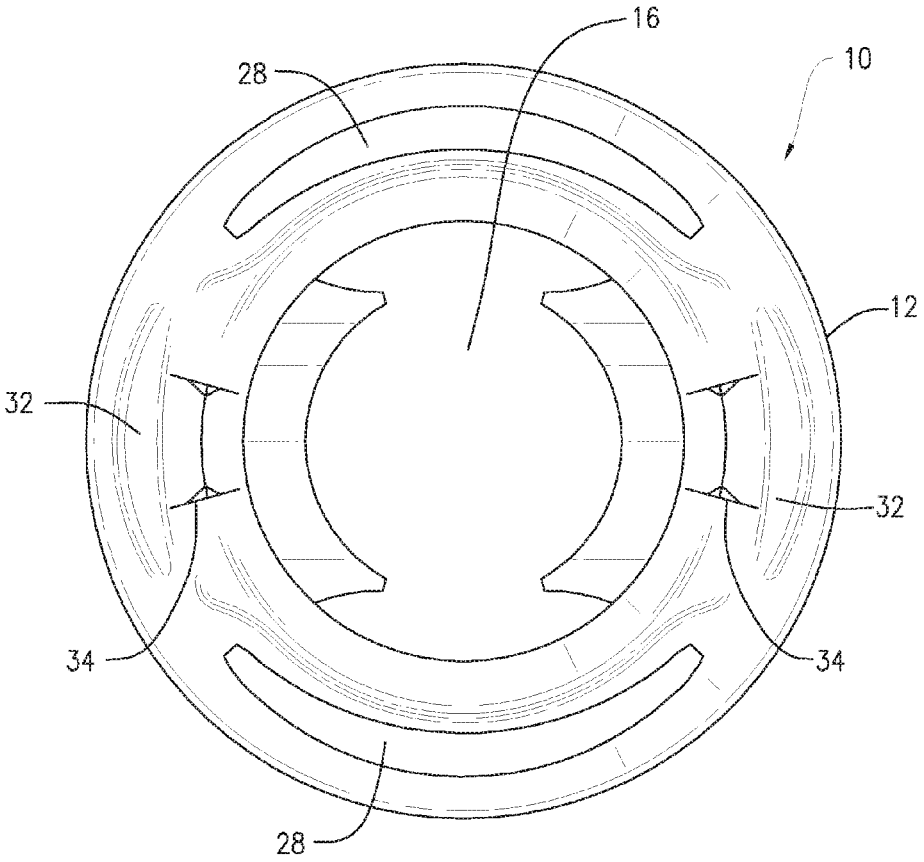
FIG. 4 is a bottom view of the suspendable light fixture shown in FIG. 1.
Figure 5:
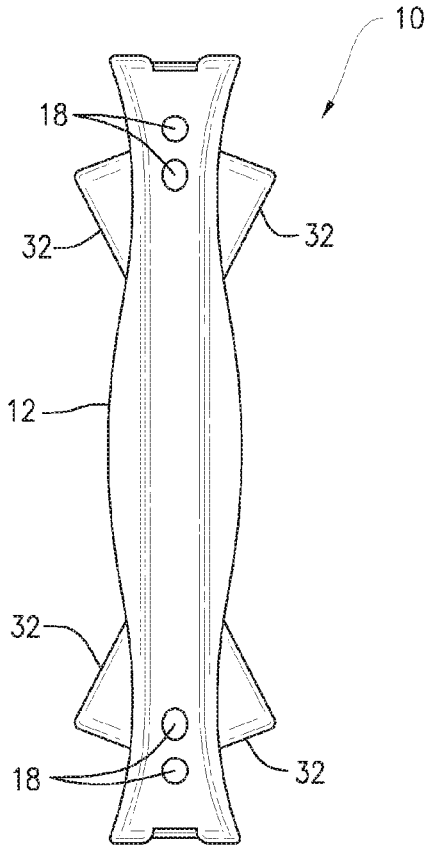
FIG. 5 is a left side view of the suspendable light fixture shown in FIG. 1.
Figure 6:
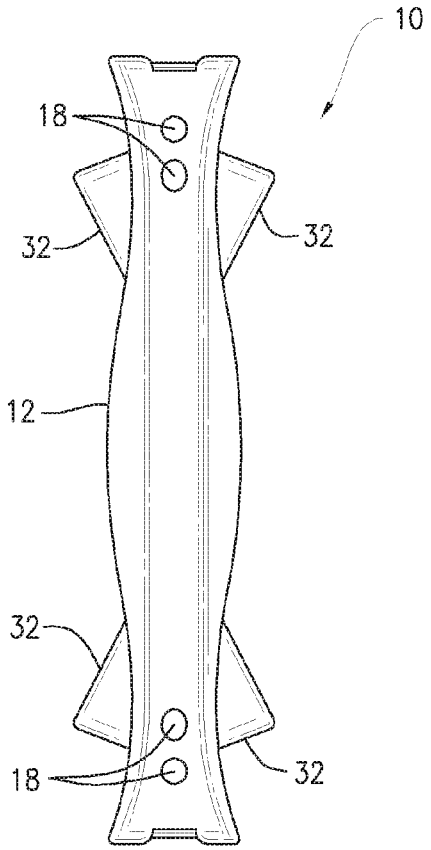
FIG. 6 is a right side view of the suspendable light fixture shown in FIG. 1.
Figure 7:
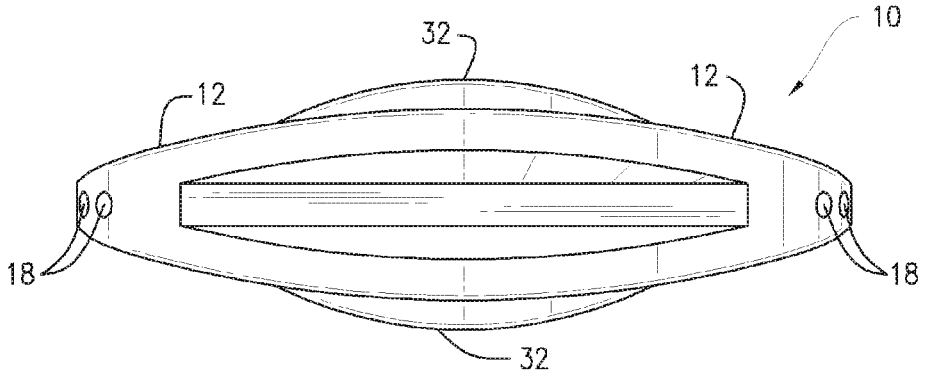
FIG. 7 is a front view of the suspendable light fixture shown in FIG. 1.
Figure 8:
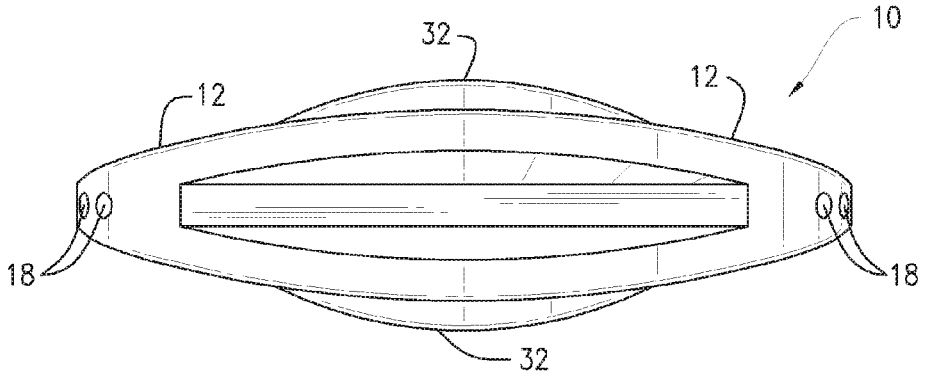
FIG. 8 is a back view of the suspendable light fixture shown in FIG. 1.

In some configurations, the housing 12 may define a plurality of grooves 28 defined between the aperture 16 and the perimeter of the housing 12. For example, a pair of arcuate grooves 32, one on each side of the housing 12 may be included. The grooves 28 may be configured to reflect light emitted from the light sources upward and/or downward through the housing 12. The length and number of each of the grooves 28 may vary depending on the desire light distribution. For example, as shown in FIG. 2, two symmetric grooves 28 are included defining an arcuate configuration. Moreover, two other smaller groves 28 are included disposed between the arcuate grooves 28.

The housing may further includes one or more ridges 32 and valleys 34 that extend above and below the housing 12. For example, the ridges 32 may be positioned adjacent a corresponding groove 28 and/or valley 34 such that a portion of the light emitted from the light source 14 may be reflected out through the groove 28 and reflected away from the housing 12 off of the ridge 32. These ridges may correspond in height and depth to the desired reflection/refraction effect. These ridges may vary in number and location based on the desired reflection/refraction effect.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A suspendable light fixture, comprising:
a housing including a light diffuser, the housing defining:
an aperture proximate the center of the housing and configured to receive a light source;
at least one pair of through holes;
a first channel extending between the at least one pair of through holes, the first channel defining a pathway entirely through the housing; and
at least one arcuate groove.

2. The light fixture of claim 1, further including a light source retained within the aperture.

3. The light fixture of claim 2, wherein the housing includes a battery configured to power the light source.

4. The light fixture of claim 2, wherein the light source is configured to be charged by a suspension element, the suspension element being configured to be slideably received within the first channel.

5. The light fixture of claim 2, wherein the light source is friction fit within the aperture.

6. The light fixture of claim 5, wherein the housing is composed of a resilient material.

7. The light fixture of claim 1, wherein the light fixture is substantially annular in shape.

8. The light fixture of claim 1, wherein the housing defines a major longitudinal axis through the center of the housing, and wherein the housing is substantially symmetric about the major longitudinal axis.

9. The light fixture of claim 1, wherein the housing defines a thickness in the range of 0.25 to 2 inches and a diameter in the range of 2 to 12 inches.

10. A suspendable light fixture, comprising:
a housing defining:
an aperture being defined proximate the center of the housing and configured to releasably retain a light source;
a first through hole defining a first channel, the first channel extending from the first through hole to the aperture;
a second through hole defining a second channel, the second channel extending from the second through hole to the aperture; and
a plurality of grooves symmetric about the aperture.

11. The light fixture of claim 10, wherein the first channel and the second channel are sized to receive a suspension element.

12. The light fixture of claim 11, wherein the suspension element is configured to provide power to the light source.

13. The light fixture of claim 10, wherein the housing defines a circumference having a first curvature, and wherein at least one of the plurality of grooves defines a second curvature substantially the same as the first curvature.

14. The light fixture of claim 10, wherein the housing defines a thickness in the range of 0.25 to 2 inches and a diameter in the range of 2 to 12 inches.

15. A suspendable light fixture, comprising:
a housing, the housing being substantially annular in shape and defining a first curvature around its exterior, the housing further defining:
an aperture being defined proximate the center of the housing and configured to friction fit and releasably retain a light source;
a first through hole defining a first channel, the first channel extending from the first through hole to the aperture;
a second through defining a second channel, the seconds channel extending from the second through hole to the aperture, the first channel and the second channel are sized to receive a suspension element; and a plurality of grooves symmetric about the aperture, at least one of the plurality of grooves collectively defining a curvature substantially the same as the curvature of the exterior surface of the housing.

* * * * *